US007433635B2

(12) United States Patent
Chou et al.

(10) Patent No.: US 7,433,635 B2
(45) **Date of Patent: *Oct. 7, 2008**

(54) METHOD AND APPARATUS FOR USING A TRANSFER ASSIST LAYER IN A MULTI-PASS ELECTROPHOTOGRAPHIC PROCESS WITH ELECTROSTATICALLY ASSISTED TONER TRANSFER

(75) Inventors: Hsin Hsin Chou, Woodbury, MN (US); Brian P. Teschendorf, Vadnais Heights, MN (US); Manuel Lozada, New Brighton, MN (US); Charles W. Simpson, Lakeland, MN (US); Truman F. Kellie, Lakeland, MN (US); A. Kristine Fordahl, St. Paul, MN (US); James A. Baker, Hudson, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 429 days.

This patent is subject to a terminal disclaimer.

(21) Appl. No.: 10/884,687

(22) Filed: Jun. 30, 2004

(65) Prior Publication Data

US 2005/0141927 A1 Jun. 30, 2005

Related U.S. Application Data

(60) Provisional application No. 60/533,592, filed on Dec. 31, 2003.

(51) Int. Cl.
*G03G 15/16* (2006.01)
*G03G 15/01* (2006.01)

(52) U.S. Cl. ..... 399/296; 399/226; 399/233; 399/302

(58) Field of Classification Search ..... 399/296, 399/302, 308, 233, 226, 228
See application file for complete search history.

(56) References Cited

U.S. PATENT DOCUMENTS 3,157,546 A 11/1964 Cover (Continued)

FOREIGN PATENT DOCUMENTS

EP 0410800 B1 1/1991

(Continued)

OTHER PUBLICATIONS

Schmidt, S.P. and Larson, J.R., in Handbook of Imaging Materials Diamond, A.S., Ed: Marcel Dekker: New York; Ch. 6, pp. 227-252., 1991.

*Primary Examiner*—Susan S Lee
(74) *Attorney, Agent, or Firm*—DLA Piper US LLP

(57) ABSTRACT

A method of producing an image on a final image receptor from image data in a multiple pass electrophotographic system is provided. The method includes the steps of applying transfer assist material to an intermediate transfer member and providing at least one development unit including a photoreceptive element and charged toner particles. During each complete processing cycle of an intermediate transfer member, a toned image is created and transferred to the intermediate transfer member by application of a bias. In multiple processing cycles of the intermediate transfer member, the transfer assist material and the at least one toned image thereby form a composite image layer on the intermediate transfer member. The method further includes contacting the composite image layer with a final image receptor while applying a bias that is sufficiently strong to transfer at least a portion of the composite image layer to the final image receptor.

55 Claims, 9 Drawing Sheets

U.S. PATENT DOCUMENTS 3,411,936 A 11/1968 Roteman et al.
3,716,360 A 2/1973 Fukushima et al.
3,808,026 A 4/1974 Sato et al.
3,893,761 A 7/1975 Buchan et al.
4,337,303 A 6/1982 Sahyun et al.
4,413,048 A 11/1983 Landa
4,420,244 A 12/1983 Landa
4,886,726 A 12/1989 Chan et al.
5,037,718 A 8/1991 Light et al.
5,102,767 A * 4/1992 Chowdry et al.
5,176,974 A 1/1993 Till et al.
5,215,852 A 6/1993 Kato et al.
5,247,331 A * 9/1993 Rydelek ..... 399/226
5,370,960 A 12/1994 Cahill et al.
5,383,008 A 1/1995 Sheridon
5,391,445 A 2/1995 Kato et al.
5,395,721 A 3/1995 Kato et al.
5,420,676 A 5/1995 Arcaro
5,432,591 A 7/1995 Geleynse
5,521,271 A 5/1996 Smith et al.
5,541,029 A * 7/1996 Iwata et al.
5,582,941 A 12/1996 Kato et al.
5,589,308 A 12/1996 Kato et al.
5,604,070 A 2/1997 Rao et al.
5,620,822 A 4/1997 Kato et al.
5,626,996 A 5/1997 Kato et al.
5,648,190 A 7/1997 Kato et al.
5,650,253 A 7/1997 Baker et al.
5,689,785 A 11/1997 Kato et al.
5,733,698 A 3/1998 Lehman et al.
5,744,269 A 4/1998 Bhattacharya et al.
5,747,214 A 5/1998 Kato et al.
5,916,718 A 6/1999 Kellie et al.
5,919,866 A 7/1999 Rao et al.
5,926,679 A * 7/1999 May et al. ..... 399/296
6,045,956 A 4/2000 Kato et al.
6,047,143 A * 4/2000 Larson et al.
6,255,363 B1 7/2001 Baker et al.
6,314,253 B1 * 11/2001 Hosoya et al. ..... 399/296
6,674,984 B2 * 1/2004 Oooka ..... 399/308
6,996,360 B2 * 2/2006 Koga et al. ..... 399/296
2002/0114637 A1 8/2002 Park et al.
2004/0091808 A1 5/2004 Qian et al.
2004/0091809 A1 5/2004 Qian et al.

FOREIGN PATENT DOCUMENTS

JP 2000267448 A * 9/2000

* cited by examiner

METHOD AND APPARATUS FOR USING A TRANSFER ASSIST LAYER IN A MULTI-PASS ELECTROPHOTOGRAPHIC PROCESS WITH ELECTROSTATICALLY ASSISTED TONER TRANSFER

REFERENCE TO RELATED APPLICATIONS

This application claims the benefit of U.S. Provisional application Ser. No. 60/533,592, filed Dec. 31, 2003, entitled "METHOD AND APPARATUS FOR USING A TRANSFER ASSIST LAYER IN A MULTI-PASS ELECTROPHOTOGRAPHIC PROCESS WITH ELECTROSTATICALLY ASSISTED TONER TRANSFER", which application is incorporated herein by reference in its entirety.

Each of the following copending U.S. Patent applications of the present Assignee are incorporated herein by reference in its respective entirety:

U.S. application Ser. No. 10/884,688, filed on even date herewith, entitled "METHOD AND APPARATUS FOR USING A TRANSFER ASSIST LAYER IN A TANDEM ELECTROPHOTOGRAPHIC PROCESS WITH ELECTROSTATICALLY ASSISTED TONER TRANSFER,"

U.S. application Ser. No. 10/884,702, filed on even date herewith, entitled "METHOD AND APPARATUS FOR USING A TRANSFER ASSIST LAYER IN A TANDEM ELECTROPHOTOGRAPHIC PROCESS UTILIZING ADHESIVE TONER TRANSFER," and U.S. application Ser. No. 10/884,339, filed on even date herewith, entitled "METHOD AND APPARATUS FOR USING A TRANSFER ASSIST LAYER IN A MULTI-PASS ELECTROPHOTOGRAPHIC PROCESS UTILIZING ADHESIVE TONER TRANSFER,"

TECHNICAL FIELD

The present invention relates to methods and systems to assist toner transfer for use with electrophotographic processes, and particularly relates to the use of such methods and systems with liquid toner materials.

BACKGROUND OF THE INVENTION

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not reuseable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, radiation sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light" or actinic radiation, may include infrared radiation, visible light, and ultraviolet radiation, for example.

In the development step, toner particles of the appropriate polarity are generally brought into contact with the latent image on the photoreceptor, typically using an electrically-biased development roller to bring the charged toner particles into close proximity to the photoreceptive element. The polarity of the development roller should be the same as that of the toner particles and the electrostatic bias potential on the development roller should be higher than the potential of the imagewise discharged surface of the photoreceptor so that the toner particles migrate to the photoreceptor and selectively develop the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the ink, a photoreceptor surface and a temporary carrier surface or medium for the toner. The effectiveness of such elastomeric assist or adhesive transfer is controlled by several variables including surface energy, temperature, force, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer may be influenced by surface energy, temperature, and force, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high force with or without heat. In the cleaning step, any residual toner remaining on the photoreceptor after the transfer step is removed. Finally, in the erasing step, the photoreceptor charge is reduced to a substantially uniformly low value by exposure to radiation of a particular wavelength band, thereby removing remnants of the original latent image and preparing the photoreceptor for the next imaging cycle.

Electrophotographic imaging processes may also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

In one exemplary electrophotographic, multi-color, multi-pass printing process, the photoreceptor takes the form of a relatively large diameter drum to permit an arrangement of two or more multi-color development units around the circumference perimeter of the photoreceptor. Alternatively, toners of varying colors can be contained in development units that are arranged on a moveable sled such that they can be individually moved into place adjacent to the photoreceptor as needed to develop a latent electrophotographic image. A single rotation of the photoreceptor drum generally corresponds to the development of a single color; four drum rotations and four sled movements are therefore required to develop a four-color (e.g. full color) image. The multi-color image is generally built up on the photoreceptor in an overlaid configuration, and then the full color image is transferred with each color remaining in imagewise registration, to a final image receptor, either directly or via an intermediate transfer element.

In an exemplary electrophotographic, four-color, four-pass full color printing process, the steps of photoreceptor charging, exposure, and development are generally performed with each revolution of the photoreceptor drum, while the steps of transfer, fusing, cleaning, and erasure are generally performed once every four revolutions of the photoreceptor. However, multi-color, multi-pass imaging processes are known in which each color plane is transferred from the photoreceptor to an intermediate transfer element on each revolution of the photoreceptor. In these processes, the transfer, cleaning and erasure steps are generally performed upon each revolution of the photoreceptor, and the full-color image is built up on the intermediate transfer element and subsequently transferred from the intermediate transfer element to the final image receptor and fused.

Alternatively, electrophotographic imaging processes may be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

A single-pass electrophotographic process for developing multiple color images is also known and may be referred to as a tandem process. A tandem color imaging process is discussed, for example, in U.S. Pat. No. 5,916,718 and U.S. Pat. No. 5,420,676. In a tandem process, the photoreceptor accepts color toners from development units that are spaced from each other in such a way that only a single pass of the photoreceptor results in application of all of the desired colors thereon.

In an exemplary four-color tandem process, each color may be applied sequentially to a photoreceptive element that travels past each development unit, overlaying each successive color plane on the photoreceptor to form the complete four-color image, and subsequently transferring the four-color image in registration to a final image receptor. For this exemplary process, the steps of photoreceptor charging, exposure, and development are generally performed four times, once for each successive color, while the steps of transfer, fusing, cleaning, and erasure are generally performed only once. After developing the four-color image on the photoreceptor, the image may be transferred directly to the final image receptor or alternatively, to an intermediate transfer member and then to a final image receptor.

In another type of multi-color tandem imaging apparatus, each individual color's development unit may include a small photoreceptor on which each color's contribution to the total image is plated. As an intermediate transfer member passes each photoreceptor, the image is transferred to the intermediate transfer member. The multi-color image is thereby assembled on the intermediate transfer element in overlaid registration of each individual colored toner layer, and subsequently transferred to the final image receptor.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227-252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1-1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68-74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3-10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Photoreceptors generally have a photoconductive layer that transports charge (by an electron transfer or hole transfer mechanism) when the photoconductive layer is exposed to activating electromagnetic radiation or light. The photoconductive layer is generally affixed to an electroconductive support, such as a conductive drum or an insulative substrate that is vapor coated with aluminum or another conductor. The surface of the photoreceptor can be either negatively or positively charged so that when activating electromagnetic radiation imagewise strikes the surface of the photoconductive layer, charge is conducted through the photoreceptor to neutralize, dissipate or reduce the surface potential in those activated regions to produce a latent image.

An optional barrier layer may be used over the photoconductive layer to protect the photoconductive layer and thereby extend the service life of the photoconductive layer. Other layers, such as adhesive layers, priming layers, or charge injection blocking layers, are also used in some photoreceptors. These layers may either be incorporated into the photoreceptor material chemical formulation, or may be applied to the photoreceptor substrate prior to the application of the photoreceptive layer or may be applied over the top of photoreceptive layer. A "permanently bonded" durable release layer may also be used on the surface of the photoreceptor to facilitate transfer of the image from the photoreceptor to either the final substrate, such as paper, or to an intermediate transfer element, particularly when an adhesive transfer process is used. U.S. Pat. No. 5,733,698 describes an exemplary durable release layer suitable for use in imaging processes using adhesive transfer.

Many electrophotographic imaging processes make use of intermediate transfer members (ITM's) to assist in transferring the developed toner image to the final image receptor. In particular, in a multipass electrophotographic process, these ITM's may contact the final image formed on the photoreceptor to assist transfer of entire image to the ITM. The image may then be transferred from the ITM to the final image receptor, typically through contact between the ITM and the final receptor.

In a tandem process, individual photoreceptors layer the images formed by the component colors on the ITM. When the entire image is composed in this manner it is typically transferred to the final image receptor. However, U.S. Pat. No. 5,432,591, for example, discloses the use of an offset roller to remove the entire image from a photoreceptor and transfer it to the final image receptor in a multi-pass liquid electrophotographic process. In various embodiments, the ITM may be an endless belt, a roller or a drum.

One continuing problem in electrophotography is to ensure that the toner particles transfer efficiently from the photoreceptor to the final image receptor, either directly or indirectly using an intermediate transfer member. Frequently, a noticeable percentage of the toner layer is left behind at each transfer step, resulting in reduced image fidelity, low optical density and poor image quality on the final image receptor, and toner residues on various machine surfaces that must be efficiently cleaned. This problem of low transfer efficiency is particularly troublesome for liquid electrophotographic toners, wherein slight variations in the carrier liquid content of the toned image can control the efficiency of elastomeric transfer or electrostatic transfer of the image from the photoreceptor or to a final image receptor.

Various attempts have been made to use transfer layers to assist transfer of liquid toned images from a temporary image receptor (e.g. a photoreceptor) or to a final image receptor (e.g. paper). For electrostatic or ionographic printing processes, a dielectric peel layer has been used to augment transfer from a temporary image receptor (see e.g. U.S. Pat. No. 5,176,974). Alternatively, an adhesive-coated protective laminating film has been used to augment transfer of liquid toners from a temporary electrographic receptor (see e.g. U.S. Pat. No. 5,370,960).

For liquid electrophotographic printing, a substantially continuous and uniform coating of a high viscosity or non-Newtonian liquid transfer layer has been applied to assist toner particle transfer from a photoreceptor and to a final image receptor using elastomeric or adhesive transfer. A variety of peelable or releasable transfer assist films have also been used in liquid electrophotographic printing processes wherein the photoreceptor has a surface release characteristic and elastomeric (adhesive) transfer is used to transfer the toned image from the photoreceptor surface. The peelable or releasable film is said to improve toner transferability, provide high quality and high fidelity multicolor images irrespective of the type of final image receptor or image receiving material, and improve storage stability of the final images (see e.g. U.S. Pat. No. 5,648,190, U.S. Pat. No. 5,582,941, U.S. Pat. No. 5,689,785 and U.S. Pat. No. 6,045,956).

Each of these methods for using a transfer assist material in a liquid electrophotographic printing process is directed to multi-pass processes that use adhesive or elastomeric transfer of the image from a specially-prepared photoreceptor having a surface release character, either directly to a final image receptor or indirectly to an intermediate transfer element and then to the final image receptor. Each of these methods involves the application of the transfer assist material as a substantially uniform or continuous film on the photoreceptor. Because the transfer assist material is deposited not only where the toned image is developed, but also in non-imaged background areas, a portion of the transfer material ends up in the background regions on the final image receptor, adding to the expense of using the transfer assist material and potentially degrading the appearance of the final image on plain paper. The art continually searches for improved liquid toner transfer processes, and for methods and materials that allow liquid toner particles to transfer more completely, producing high quality, durable multicolor images on a final image receptor at low cost.

SUMMARY OF THE INVENTION

In one aspect of the invention, a method of producing an image on a final image receptor from image data in a multiple pass electrophotographic system is provided. The method comprises the steps of providing a photoreceptive element having a determined processing cycle and providing at least one development unit containing charged toner particles, wherein at least one of the photoreceptive element and each development unit are moved into a processing position relative to each other. The following steps (a) through (c) are then preferably performed for each development unit during each complete processing cycle of the photoreceptive element: (a) applying a substantially uniform first electrostatic potential to the surface of the photoreceptive element; (b) selectively photodischarging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the charged toner particles, wherein the charged toner particles selectively deposit on the discharged portions of the surface of the photoreceptive element to develop the first latent image and create a toned image. The method further comprises the steps of providing a transfer assist material development unit containing a liquid transfer assist material with charged particles and moving at least one of the photoreceptive element and the transfer assist material development unit into a processing position relative to each other. The transfer assist material is then applied to at least a portion of the toned image during the processing cycle of the photoreceptive element to form a composite image layer on the photoreceptive element. The method further comprises the step of contacting the composite image layer with a final image receptor while applying a an electrostatic bias potential through the final image receptor that is sufficiently strong to transfer at least a portion of the composite image layer from the photoreceptive element to the final image receptor. In an alternative embodiment of the present invention, the transfer assist material is applied to the photoreceptive element prior to the transfer of toner particles to the photoreceptive element.

In another aspect of the present invention, an alternate method of producing an image on a final image receptor from image data in a multiple pass electrophotographic system having an intermediate transfer member is provided. The method comprises the steps of providing a transfer assist material development unit containing a liquid transfer assist material comprising charged particles, and moving at least one of the intermediate transfer member and the transfer assist material development unit into a processing position relative to each other. Then, the transfer assist material is applied to at least a portion of the intermediate transfer member. The method further includes the steps of providing a least one development unit comprising a photoreceptive element and charged toner particles, wherein at least one of the photoreceptive element and each development unit are moved into a processing position relative to each other. The following steps (a) through (d) may then be performed for each development unit during each complete processing cycle of an intermediate transfer member: (a) applying a substantially uniform first electrostatic potential to the surface of the photoreceptive element; (b) selectively photodischarging portions of the surface of the photoreceptive element in an imagewise manner to create a first latent image having a second electrostatic potential that is less than the absolute value of the first electrostatic potential on the surface of the photoreceptive element; (c) exposing the surface of the photoreceptive element to the charged toner particles, wherein the charged toner particles selectively deposit on the discharged portions of the surface of the photoreceptive element to develop the first latent image and create a toned image; and (d) transferring at least a portion of the toned image on the photoreceptive element to the intermediate transfer member by applying a bias that is sufficiently strong to transfer at least a portion of the toned image from the photoreceptive element to the intermediate transfer member. The transfer assist material and the at least one toned image thereby form a composite image layer on the intermediate transfer member in multiple processing cycles of the intermediate transfer member. The method further comprises the step of contacting the composite image layer with a final image receptor while applying a bias through the final image receptor that is sufficiently strong to transfer at least a portion of the composite image layer from the intermediate transfer member to the final image receptor. In an alternative embodiment, a first latent image is formed on the intermediate transfer member prior to the step of applying the transfer assist material to the intermediate transfer member.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Effective transfer of liquid toner throughout the various necessary steps required in an electrophotographic process to reach a final substrate can present some challenges. In accordance with the present invention, the inclusion of a transfer assist layer or transfer assist material in certain multi-pass electrophotographic processes may provide certain advantages, depending on where in the multi-pass process this layer is used. A transfer assist layer, as described herein, is not necessarily any one specific material or type of material, although it is preferably a generally clear material, such as a nonpigmented ink. In accordance with the present invention, it may be beneficial for a transfer assist layer to have release properties so that the transfer assist layer and the toner layers do not adhere to a photoreceptor, for one example. It is not a requirement that the layer provide release properties, however. A transfer assist layer may also have additional, unique benefits that add value and quality to a print aside from any problem-solving characteristics it may have, as will be discussed in further detail below.

Figure 1:
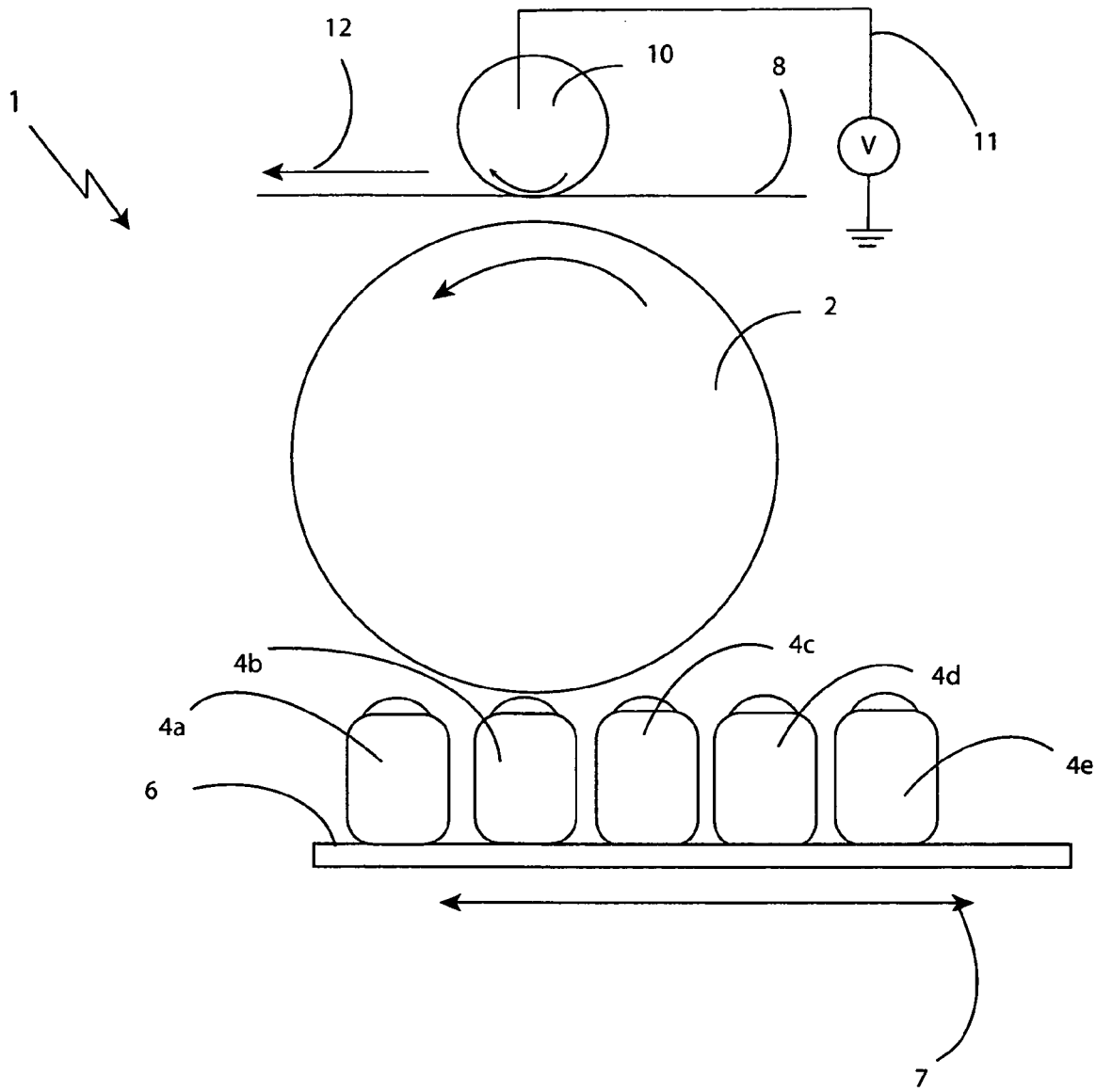
FIG. 1 is a schematic view of a portion of an electrophotographic apparatus using a multi-pass configuration in an electrostatic transfer process, in accordance with the present invention.

The present invention will be further explained with reference to the appended Figures, wherein like structure is referred to by like numerals throughout the several views, and wherein FIG. 1 is a schematic drawing of the relevant parts of an electrophotographic apparatus 1 using a multi-pass process that uses electrostatic transfer. A photoreceptor or photoreceptive element 2 is included in the electrophotographic apparatus 1 and is configured so that multiple development units or stations 4*a*, 4*b*, 4*c*, 4*d*, and 4*e* can be moved to a processing position relative to the photoreceptor 2 as needed. As described herein, when the development units or stations are in a processing position relative to a photoreceptor, the development units may be in contact with the photoreceptor or there may instead by a slight gap between the development units or stations and any photoreceptors. If a gap is provided, the electrostatic forces are preferably adjusted to accommodate the additional distance the materials will need to move to transfer to the photoreceptor. Further, it is understood that only one of the photoreceptor and the development units may be moved to situate the components in their desired positions relative to each other, or that both the photoreceptor and the development units or stations may be moved to achieve the desired arrangement. When five development units are provided in a particular apparatus, it is preferable that four of the development units provide pigmented liquid ink material and that one development unit provides a transfer assist material. Further, while five development units are provided in this embodiment, more or less than five development units may be provided for a particular electrophotographic apparatus, with a wide variety of possible combinations of the number of development units containing liquid inks and the number of development units containing transfer assist materials within a single electrophotographic apparatus.

The photoreceptor 2 is shown in this non-limiting example as a drum, but may instead be a belt, a sheet, or some other photoreceptor configuration. A single rotation of the photoreceptor may be referred to as a processing cycle, which generally corresponds to the development of a single color. Thus, four rotations or processing cycles of a photoreceptor configured as a drum and four corresponding positioning of development units relative to the photoreceptor would typically be required to develop a four color (e.g. full color) image. When the photoreceptor is in a different form than a drum, a processing cycle will generally correspond to one complete movement of the photoreceptor from a start position, through intermediate positions, then to an end position, where the end position of one cycle may optionally correspond with the start position for the next upcoming cycle. In one exemplary embodiment, the photoreceptor is a drum having a processing cycle that includes the steps of photoreceptor charging, exposure, and development during each revolution thereof The development units 4*a*-4*e* preferably each hold charged liquid ink or transfer assist material and include at least one compliant roller that attracts the charged pigmented or nonpigmented ink or toner particles for application of the charged particles to discharged areas on the photoreceptor, as desired. One such compliant roller that may be provided can be referred to as a developer roller, which would typically be rotated within its development unit to ensure even coverage of the liquid toner to the photoreceptor. U.S. Pat. No. 5,916,718 describes one example of a development unit or development cartridge that may be used in a multi-pass electrophotographic process and is incorporated herein by reference. U.S. Pat. No. 5,432,591 is yet another example of a development unit or development cartridge that may be used in a multi-pass electrophotographic process, such as that of the present invention, and is incorporated herein by reference. It is understood, however, that the development units used within the processes of the present invention may include a wide variety of different configurations and equipment for transferring ink or transfer assist materials to a photoreceptor.

FIG. 1 shows an example of one preferred embodiment of a development unit positioning track 6 that may be mechanized in sliding or translating-type movement (such as is illustrated by arrow 7) to position each development unit (4*a*, 4*b*, 4*c*, 4*d*, or 4*e*) relative to the photoreceptor 2, as desired. Movement of the track 6 may preferably allow for sequential positioning of the development units 4*a*-4*e* in a processing position relative to the photoreceptor 2, although it is not required that all development units be positioned in a processing position relative to the photoreceptor 2 for a particular image. Further, it is possible that a particular development unit be moved to its processing position more than once in the production of a single image. In addition, the order or sequence in which the development units 4*a*-4*e* provide material to the photoreceptor 2 does not necessarily require sequential use of adjacent development units (e.g., development unit 4*b* need not necessarily provide material to the photoreceptor immediately after development unit 4*a*). Rather, the positioning track 6 may be controlled so that nonadjacent development units may sequentially be moved to their processing positions relative to the photoreceptor 2, such that a single apparatus provides flexibility of the order in which the development units provide material to the photoreceptor 2. One example of a process using mechanized developer rollers is described in U.S. Pat. No. 5,434,591, the contents of which are incorporated herein by reference. However, a variety of systems and equipment may instead be used for movement of the development units in place of a sliding track system such as the development unit-positioning track 6 of FIG. 1.

The liquid toner or non-pigmented transfer assist materials (not shown) provided within the development units 4*a*, 4*b*, 4*c*, 4*d*, and 4*e* preferably have a charge director and are attracted to the discharged regions of the photoreceptor 2 when the discharged regions of the photoreceptor 2 are adjacent to or in contact with one of the development units. The discharged regions of the photoreceptor 2 are typically provided by selectively photodischarging portions of the surface of the photoreceptive element in an imagewise manner, such as with the use of light. This charge director is typically used to facilitate electrostatic transfer of toner particles or transfer assist materials. One example of the preparation of a charged toner is described in U.S. Pat. No. 6,255,363, which is incorporated herein by reference. The charge director, which is sometimes referred to in the art as the charge control agent, typically provides the desired uniform charge polarity of the toner particles. In other words, the charge director acts to impart an electrical charge of selected polarity onto the toner particles as dispersed in the carrier liquid. Preferably, the charge director is coated on the outside of the binder particle. Alternatively or additionally, the charge director may be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive may be adjusted based on a variety of parameters to achieve the desired results for a particular application.

Any number of charge directors described in the art may be used in the liquid toners or transfer assist materials of the present invention in order to impart an electrical charge of selected polarity onto the toner particles. For example, the charge director may be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), Bi(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps), such as those described in U.S. Pat. No. 3,411,936, incorporated herein by reference. A particularly preferred positive charge control agent is zirconium tetraoctoate (available as Zirconium HEX-CEM from OMG Chemical Company, Cleveland, Ohio).

Any number of charge directors such as those described in the art may be used in the liquid toners or transfer assist materials of the present invention in order to impart a negative electrical charge onto the toner particles. For example, the charge director may be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt (e.g., Na) of a phosphoglyceride. A preferred example of such a charge director is Emphos™ D70-30C, Witco Chemical Corp., New York. N.Y., which is a sodium salt of phosphated mono- and diglycerides.

The preferred charge direction levels for a given toner formulation will depend upon a number of factors, including the composition of a graft stabilizer and organosol, the molecular weight of the organosol, the particle size of the organosol, the core/shell ratio of the graft stabilizer, the pigment used in making the toner, and the ratio of organosol to pigment. In addition, preferred charge direction levels will also depend upon the nature of the electrophotographic imaging process, particularly the design of the developing hardware and photoreceptive element. It is understood, however, that the level of charge direction may be adjusted based on a variety of parameters to achieve the desired results for a particular application.

Once the photoreceptor 2 has received the liquid toner layers and any transfer assist layers, the composite image may be transferred directly to a final image receptor 8 that is traveling in the direction of arrow 12. The transfer roller 10 may be biased as shown by the representation 11 to affect an electrostatic transfer of the entire image from the photoreceptor 2 to the final image receptor 8. Because the toned image will preferably be maintained on the photoreceptor 2 due to electrostatic attraction forces, a significantly greater electrical field will be necessary to pull or attract the charged toner particles away from the photoreceptor 2 toward the final receptor 8. Thus, by applying a relatively high electrical voltage of the proper polarity to the transfer roller 10, the electrical field between the photoreceptor 2 and the transfer roller 10 causes the toner particles to deposit on the final image receptor 8.

In accordance with the present invention, at least one of the development units **4*a*-4*e* contains a transfer assist layer for application to the photoreceptor 2 in a variety of different sequential processes, as will be described below. A transfer assist layer in this type of apparatus may be a colorless liquid such as an unpigmented liquid toner (organosol) that contains charge director. The charge director will enable the transfer assist material to electrostatically transfer to the area to be imaged (or that is already imaged) on the photoreceptor 2 and to the final receptor 8. In this process, because the liquid toner development units 4*a*, 4*b*, 4*c*, 4*d*, 4*e* are positioned to contact or be adjacent to the photoreceptor 2** as needed, the transfer assist material may be placed in any of the development units. This multi-pass system thus provides the advantage of being relatively flexible in the application of multiple layers in various sequences, which sequences may be changed through reprogramming of computer instructions, for example.

The other development units of a particular electrophotographic apparatus, which may be referred to as toner development units, preferably contain the colors cyan (C), magenta (M), yellow (Y), and black (K), but the colors in each development unit may include any color including, for example, a red (R), green (G), blue (B), and black (K) system, or other variations. In accordance with the present invention, it is understood that any toner layer or image may include one or more colors or layers, but such layers and images are generally shown and described herein as a single toner layer, for clarity of description and illustration. Computer signals may then govern at what point the transfer assist material is applied to the photoreceptor 2. The transfer assist material may be applied to the photoreceptor 2 before the colored toners are applied, or over the toned image, as described below.

When used as part of a toner composition, various suitable toner resins may be selected for incorporation with the transfer assist materials of the present invention. Illustrative examples of typical resins include polyamides, epoxies, polyurethanes, vinyl resins, polycarbonates, polyesters, and the like and mixtures thereof. Any suitable vinyl resin may be selected including homopolymers or copolymers of two or more vinyl monomers. Typical examples of such vinyl monomeric units include: styrene; vinyl naphthalene; ethylenically unsaturated mono-olefins such as ethylene, propylene, butylene, isobutylene and the like; vinyl esters such as vinyl acetate, vinyl propionate, vinyl benzoate, vinyl butyrate and the like; ethylenically unsaturated diolefins, such as butadiene, isoprene and the like; esters of unsaturated monocarboxylic acids such as methyl acrylate, ethyl acrylate, n-butyl acrylate, isobutyl acrylate, dodecyl acrylate, n-octyl acrylate, phenyl acrylate, methyl methacrylate, ethyl methacrylate, butyl methacrylate and the like; acrylonitrile; methacrylonitrile; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and mixtures thereof. Also, there may be selected as toner resins various vinyl resins blended with one or more other resins, preferably other vinyl resins, which insure good triboelectric properties and uniform resistance against physical degradation. Furthermore, nonvinyl type thermoplastic resins may also be employed including resin modified phenolformaldehyde resins, oil modified epoxy resins, polyurethane resins, cellulosic resins, polyether resins, polyester resins, and mixtures thereof.

Preferably, the toner comprises a graft amphipathic copolymer that has been dispersed in a liquid carrier to form an organosol, then mixed with other ingredients to form a liquid toner composition. Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

Once the organosol has been formed, one or more additives can be incorporated, as desired. For example, one or more visual enhancement agents (such as tinting materials) and/or charge control agents or directors can be incorporated. The composition can then subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 5 microns) and may also partially shred the dispersed copolymeric binder into fragments that can associate with the surface of the visual enhancement additive.

The dispersed copolymer or fragments derived from the copolymer may then associate with the visual enhancement additive, for example, by adsorbing to or adhering to the surface of the visual enhancement additive, thereby forming toner particles. The result is a sterically-stabilized, nonaqueous dispersion of toner particles having a volume mean particle diameter (determined with laser diffraction) in the range of about 0.05 to about 50.0 microns, more preferably in the range of about 1 to about 10 microns, most preferably in the range of about 1.5 to about 5 microns. In addition, the toner particles used for the electrostatic transfer processes of the present invention preferably have effective glass transition temperatures greater than about 35° C., and may be above about 40° C. In some embodiments, one or more charge control directors or agents can be added before or after mixing, if desired.

The liquid carrier of the pigmented inks and pigmented or non-pigmented toner assist materials is preferably a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water. The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, N.J.), and most preferred carriers are the aliphatic hydrocarbon solvent blends such as Norpar™ 12, Norpar™13 and Norpar™ 15 (available from Exxon Corporation, N.J.). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization may be carried out in any appropriate solvent, and a solvent exchange may be carried out to provide the desired liquid carrier for the toner composition.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and are seen in the low relationship between current density and toner deposited during development. Low conductivities indicate little or no charging of the toner particles and lead to very low development rates. The use of charge control directors or agents matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

Figure 2A:
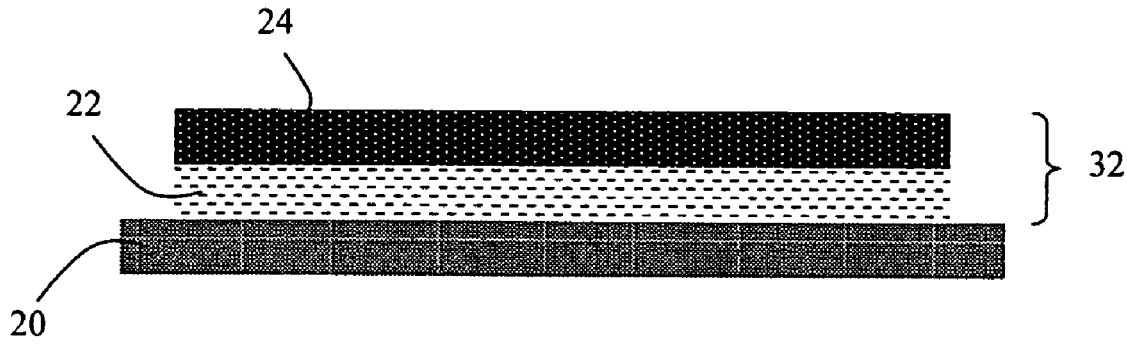
FIGS. 2*a* and 2*b* are side schematic views of an arrangement of toner and transfer assist layers in the steps involving toner transfer from a photoreceptor to a final receptor, where a transfer assist layer is applied to the photoreceptor before an ink/toner layer is applied.
Figure 2B:
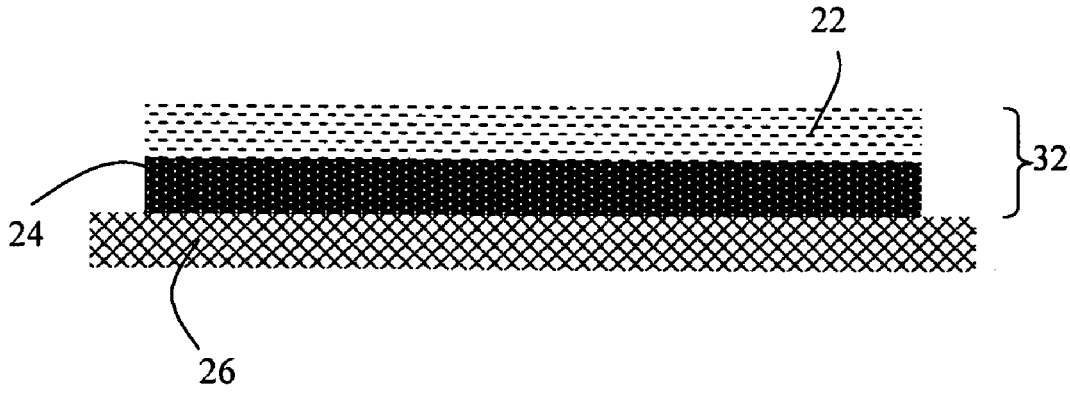

FIG. 2*a* shows a transfer assist layer 22 as applied or positioned on a photoreceptor 20, such as could be applied by an apparatus such as the apparatus 1 of FIG. 1. A toner layer 24, which may include one or more colors applied in any desired sequence, is applied or positioned so that it at least partially covers the transfer assist layer 22. FIG. 2*b* illustrates the arrangement of the layers of FIG. 2*a* in its configuration after the image is transferred from the photoreceptor 20 to a final image receptor 26. When the transfer assist layer 22 is placed on the photoreceptor 20 before the toner layer or layers 24, as in this embodiment, transfer of the image to the final receptor 26 places the toner layer 24 in direct contact with the final receptor 26 and places the transfer assist layer 22 on the outside. Any of the various combinations of transfer assist layer or layers 22 and the toner layer or layers (i.e., a composite layer) 24 are described herein as a composite, complete, or total image layer 32.

When the transfer assist layer 22 is applied to the photoreceptor 20 before the toner layer or layers 24 in this way, the layer 22 may provide any of several advantages. Typically, when choosing toner particle sizes for electrophotographic applications that use electrostatic transfer, the size of the pigmented ink particles is an important consideration. Preferably, the volume mean particle diameter (determined with laser diffraction, for example) of the particles is in the range of about 0.05 to about 50.0 microns, more preferably in the range of about 1 to about 10 microns, and most preferably in the range of about 1.5 to about 5 microns. If the pigmented ink particles are relatively large, such as between about 1 and about 5 microns, for example, the toner may transfer relatively easily from the photoreceptor to another member such as an optional intermediate transfer member, for example. However, these large pigmented ink particles may also produce uneven print images because there may be gaps or voids in the toned images due to the fact that the particles are too large to evenly cover the print surface. Conversely, relatively small pigmented ink particles (e.g., less than 1 micron) can produce a very fine resolution image in some cases; however, because the particles are so small, a relatively thick layer of toner may be needed to provide the desired density of the image. This relatively thick toner layer can be too thick to transfer properly, which may result in leaving some or all of the toner layers behind (i.e., the toner layers do not transfer from a substrate). Thus, it can be advantageous, in accordance with the present invention, to provide a transfer assist layer having relatively large pigmented ink particles adjacent to (e.g., underneath or over) a relatively thick layer of small particle toner pigment to help the entire pigmented layer transfer more efficiently, resulting in a more complete toner transfer that maintains the desired optical density. Preferably, the volume mean particle diameter (determined with laser diffraction, for example) of the charged transfer assist material particles is in the range of about 0.05 to about 50.0 microns, more preferably in the range of about 1 to about 10 microns, and most preferably in the range of about 1.5 to about 5 microns.

Thus, the direct transfer of the toner layer 24 from the photoreceptor 20 to the final substrate 26 may be improved by charging the transfer assist layer 22 and by using a relatively large particle size for the particles in the transfer assist material. Further, a transfer assist layer may serve as a release layer, with some or all of the transfer assist layer transferring to the final image receptor with the pigmented particles of the final image. The transfer layer, which is preferably transparent, may then fill in microscopic voids or gaps in the toner layer, thereby improving the image appearance, optical density, or gloss of the image. Some examples of transfer assist materials that can be used for release include organosols that incorporate release functionality, typically in the graft stabilizer, where specific examples include graft stabilizers comprising silicone monomers or polydimethylsiloxane. Other examples of materials that can help provide release properties include those discussed in U.S. Pat. Nos. 5,521,271, 5,604,070, and 5,919,866, which provide lists of examples of polymeric dispersions that include surface release promoting moieties, the disclosures of which are incorporated herein by reference. In order to further promote release properties (i.e., minimize or eliminate tackiness), it is further preferable that the transfer assist material has a glass transition temperature greater than about 35° C. and may be greater than about 40° C.

Figure 3A:
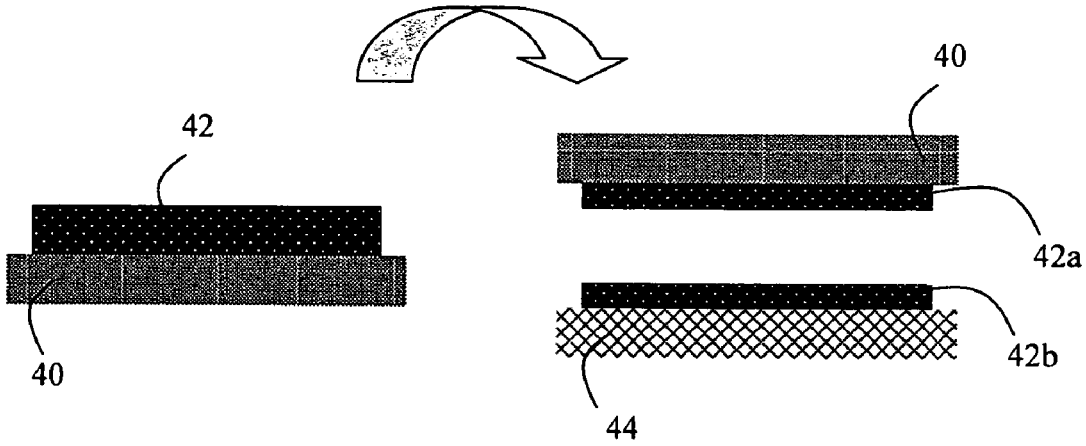
FIGS. 3*a* and 3*b* are side schematic views of toner and transfer assist layers arranged relative to each other, including splitting of layers with and without the use of a transfer assist layer.
Figure 3B:
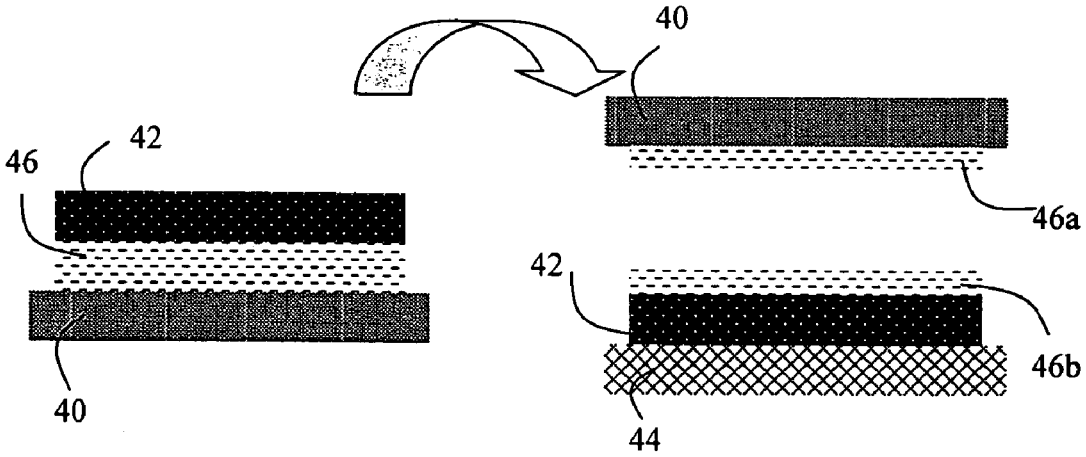

FIGS. 2*a* and 2*b* show how a transfer assist layer may be incorporated to provide complete release from a photoreceptor, but complete (100%) transfer may not be necessary when a transfer assist layer is used. In FIGS. 3*a* and 3*b*, for example, the transfers of an image with and without a transfer assist layer are illustrated, where FIG. 3*b* shows the use of a transfer assist layer as a "sacrificial layer". First, in FIG. 3*a*, a photoreceptor 40 is shown having a toned image (toner layer) 42 thereon. As indicated by the arrow, the second step of this process shows transfer of that image to a final receptor 44 in which the entire toner layer 42 does not transfer. This figure shows that if there is incomplete toner transfer, only a portion of the toner layer 42 is transferred to the final receptor 44 and is shown as a layer 42*b* (a partial layer). The portion 42*a* that remains behind on the photoreceptor 40 is toner that contributed to the quality and optical density of the image. The result can be an image on a final substrate having diminished optical quality and a "papery" appearance due to the presence of scattered microvoids in the image.

FIG. 3*b* shows the same phenomenon where a transfer assist layer is used, in accordance with the present invention. In particular, a photoreceptor 40 with a layer of transfer assist material 46 and a layer of toner 42 is provided. As indicated by the arrow, the second step of this process occurs when it is desired to transfer the image to the final substrate. As shown in this figure, the transfer assist layer 46 "splits" or divides in such a way that a portion of the transfer assist layer 46*b* goes with the toner layer 42 to the final image receptor 44, and a portion of the transfer assist layer 46*a* remains behind on the photoreceptor 40. Advantageously, the entire toner image layer 42 is thereby transferred to the final image receptor 44, thereby assisting in maintaining a desirable optical density of the image.

This process may have additional advantages not related to transfer assistance. For example, a transfer assist layer may have additives to make it a durable image protectant when the image is fixed or fused to the final receptor. Examples of such additives include organosols that incorporate high $T_g$ monomers, such as TCHMA, isobornylacrylate, or isobornylmethacrylate, (as is described, for example, in co-pending U.S. Patent Application of the present Assignee Ser. No. 10/612,765, filed Jun. 30, 2003, entitled "ORGANOSOL INCLUDING HIGH TG AMPHIPATHIC COPOLYMERIC BINDER AND LIQUID TONERS FOR ELECTROPHOTOGRAPHIC APPLICATIONS" the entire content of which is incorporated herein by reference, or that incorporate covalently bonded polymerizable, crystallizable monomers such as acrylates or methacrylates with carbon numbers including and between $C_{16}$ and $C_{26}$ (e.g., hexadecyl-acrylate or -methacrylate, stearyl-acrylate or -methacrylate, or behenyl-acrylate or -methacrylate) (as is described, for example, in co-pending U.S. Patent Application of the present Assignee Ser. No. 10/612,534, filed Jun. 30, 2003, entitled "ORGANOSOL LIQUID TONER INCLUDING AMPHIPATHIC COPOLYMERIC BINDER HAVING CRYSTALLINE COMPONENT" the entire content of which is incorporated herein by reference).The transfer assist layer can also be adjusted to have properties that, for example, offer abrasion resistance or protection from ultraviolet light. It can also be modified to provide a glossy surface, enhancing the way the image looks on the final receptor. These features are not requirements of an effective transfer assist layer, but they could be elements of an enhanced transfer assist layer that solves other imaging problems or defects.

As discussed above with respect to FIG. 1, the transfer assist material may be placed in any development unit position (4*a*, 4*b*, 4*c*, 4*d*, or 4*e*) for plating to the photoreceptor 2. However, the embodiments described above include processes in which the development unit containing the transfer assist material applies the transfer assist material to the photoreceptor prior to the application of any toner materials. The transfer assist layer may instead be applied to the photoreceptor 2 after the toned image is layered on the photoreceptor, as described below.

Figure 4A:
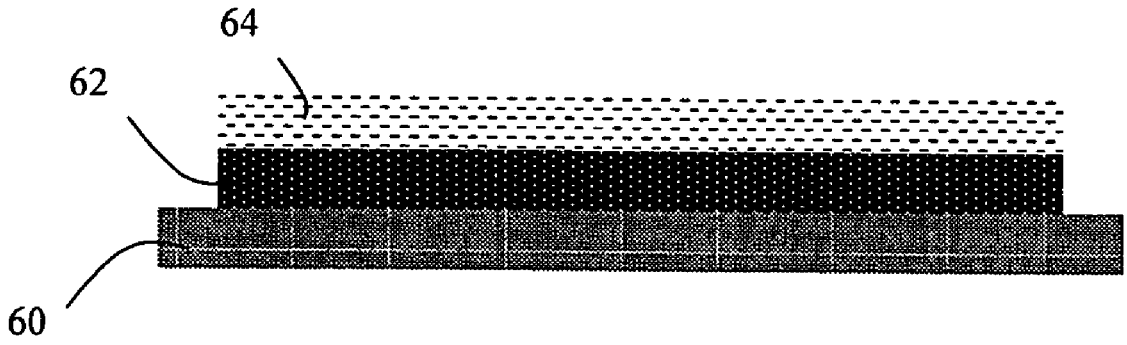
FIGS. 4*a* and 4*b* are side schematic views of an arrangement of toner and transfer assist layers in the steps involving toner transfer from a photoreceptor to a final receptor, where a transfer assist layer is applied to the photoreceptor after an ink/toner layer is applied.
Figure 4B:
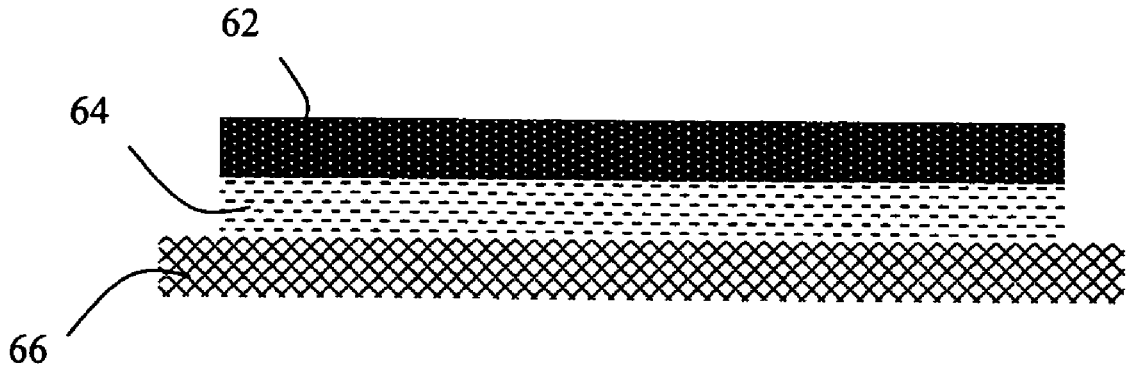

FIGS. 4*a* and 4*b* illustrate another embodiment of the present invention in which the layers and the transfer steps are shown for a process wherein a transfer assist layer is initially placed over the toned image. In particular, FIG. 4*a* shows a photoreceptor 60, with a complete toned image positioned thereon made up of at least one toner layer 62 and a transfer assist layer 64 at least partially covering the toner layer 62. When the image is then transferred to the final receptor 66 (as shown in FIG. 4*b*), the transfer assist layer 64 contacts the final image receptor 66 and the toner layer 62 is on the outside (i.e., the toner layer 62 is the top layer).

This embodiment of FIGS. 4*a* and 4*b* illustrates the improved transfer efficiency that may be achieved through the use of a transfer assist layer in this position. In particular, this transfer efficiency may be enhanced due to the thicker toner layer of charged particles that tends to encourage electrostatic transfer through the addition of more charged particles. A transfer assist layer used in this way does not necessarily promote transfer efficiency by providing a layer for release or splitting from the photoreceptor. However, in this embodiment, the transfer assist layer can be used to bond electrically with relatively small pigment particles, thereby creating stronger cohesive strength and larger charged particles to enhance and improve transfer efficiency and quality.

Further, this embodiment of a transfer assist layer may be formulated to have a tacky surface, thereby encouraging a bond between the pigmented toner particles and the final image receptor. In fact, if the glass transition temperature ($T_g$) is formulated to be relatively low (making it tacky), it is possible that a relatively low to moderate fusing temperature can enable the pigment particles to melt and flow more easily into a porous final receptor, thereby creating a strong bond between the toner and the final receptor. Preferably, the transfer assist layer of this embodiment has a $T_g$ that is lower than about 35° C. and could be below about −10° C. In addition, the transfer assist layer can include enhancement properties that facilitate fusing of the image at lower temperatures than without such a transfer assist layer, which can provide benefits from a manufacturing and safety standpoint. Additionally, this embodiment may have benefits that are not necessarily related to improving transfer efficiency, such as providing a base coat (that might promote, for example, adhesion) between the toned image and the final substrate. This might be particularly useful with respect to the printing of liquid toners on overhead projection film (OHP film), for example.

Figure 5:
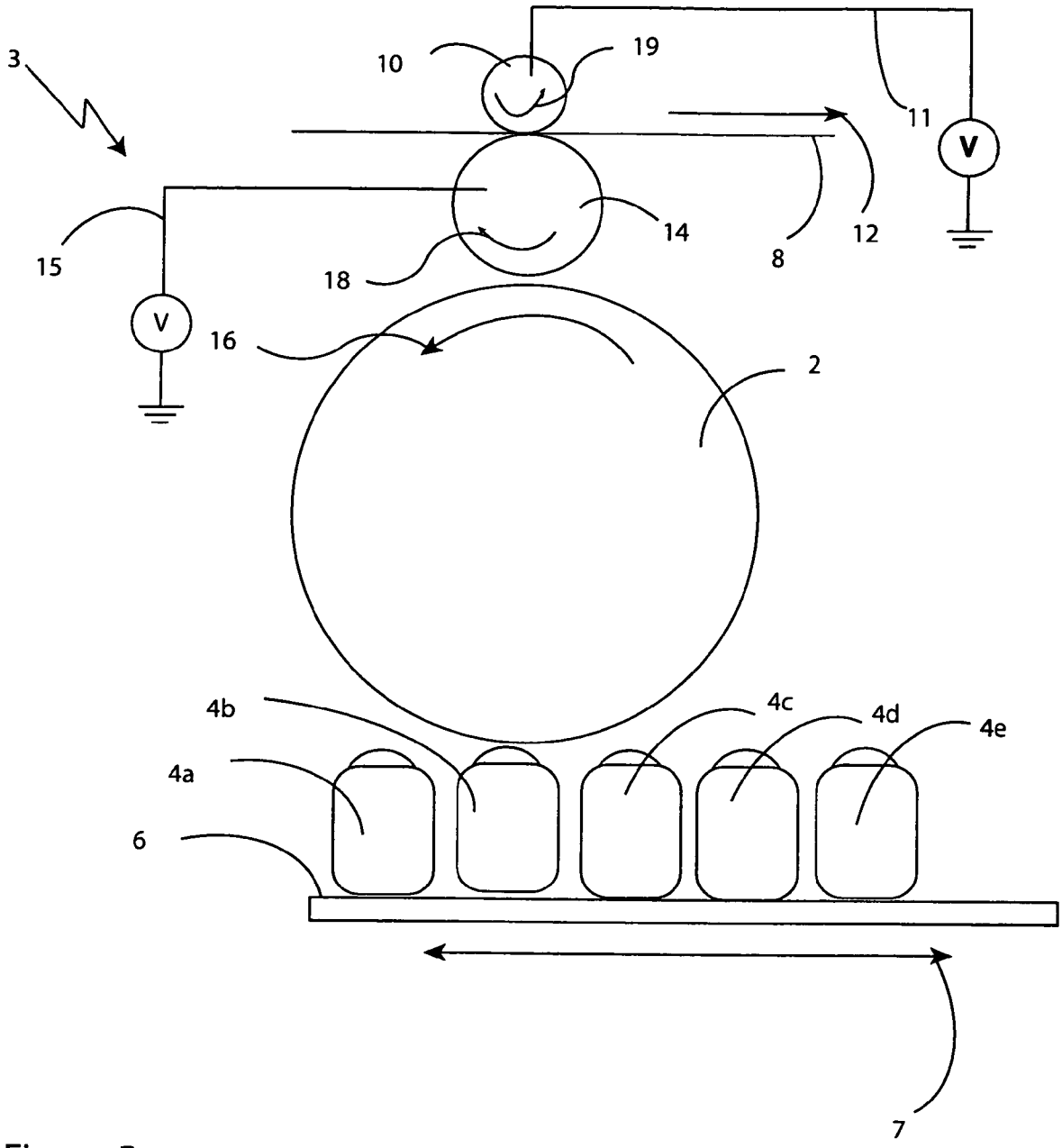
FIG. 5 is a schematic view of a portion of an electrophotographic apparatus using a multi-pass process that uses electrostatic transfer and an intermediate transfer member.

FIG. 5 shows another embodiment of an electrophotographic apparatus 3 in accordance with the present invention, which is similar to the apparatus of FIG. 1. The apparatus 3 additionally incorporates the use of an intermediate transfer member 14 positioned between at least one photoreceptor 2 and a backup or transfer roller 10. A photoreceptor 2 is included in the electrophotographic apparatus 3 and is positioned so that multiple development units 4*a*, 4*b*, 4*c*, 4*d*, and 4*e* can be moved into place relative to the photoreceptor 2 for processing as needed. While five development units are provided in this embodiment, more or less than five development units may be provided for a particular electrophotographic apparatus. These units may comprise at least one development unit containing toner and at least one development unit containing transfer assist material. The photoreceptor 2 is shown in this non-limiting example as a drum, but may instead be a belt, a sheet, or some other photoreceptor configuration As with the apparatus 1 of FIG. 1, one preferred embodiment of a development unit in the apparatus 3 of FIG. 5 includes a positioning track 6 that may be mechanized in sliding or translating-type movement (such as is illustrated by arrow 7) to position each development unit (4*a*, 4*b*, 4*c*, 4*d*, or 4*e*) in its processing position relative to the photoreceptor 2, as desired. It is understood, however, that the photoreceptor may instead be movable to establish the processing position of the photoreceptor relative to one or more development units, or that both the photoreceptor and the development units may be movable relative to each other.

Movement of the track 6 or other mechanism used for positioning of development units may preferably allow for sequential positioning of the development units 4*a*-4*e* relative to the photoreceptor 2, although it is not required that all development units are positioned in this way for a particular image. Further, it is possible that a particular development unit or plural development units each contact the photoreceptor 2 more than once in the production of a single image. In addition, the order or sequence in which the development units 4*a*-4*e* contact the photoreceptor 2 does not necessarily require sequential use of adjacent development units (e.g., development unit 4*b* need not necessarily contact the photoreceptor immediately after development unit 4*a*). Rather, the positioning track 6 may be controlled so that nonadjacent development units may sequentially contact the photoreceptor 2. In this way, a single apparatus provides flexibility of the order in which the development units are placed in their processing position relative to the photoreceptor 2.

In the multiple passes of this process, the desired number of toner layers and possibly also the desired number of transfer assist material layers are applied to the photoreceptor 2 by the various development units. The toned images, which may or may not include at least one transfer assist material layer, are then transferred to the intermediate transfer member 14

(shown here as an intermediate transfer roller, but which may be a sheet, drum or belt) before transfer to the final image receptor 8. This transfer of the toner layer or layers on the photoreceptive element 2 to the surface of the intermediate transfer member 14 can be facilitated by moving either the intermediate transfer member 14, the photoreceptor 2, or both the member 14 and the photoreceptor 2 into close proximity or in contact with each other. To accomplish this, the intermediate transfer member 14 is preferably biased (as designated by reference number 15) to provide a stronger electrostatic pull on the toned image than is provided by the photoreceptor 2. In this way, the image may be transferred to the intermediate transfer member 14 as it rotates in a direction shown by arrow 18. The final image receptor 8, which is moving in a direction indicated by arrow 12, may then be pressed against the intermediate transfer member 14 by the transfer roller 10, which is preferably biased and rotating in a direction indicated by arrow 19. As the image rotates along the outer perimeter of the intermediate transfer member 14 to come in contact with the final receptor 8, the bias of the transfer roller 10 attracts the toner and any charged transfer assist material particles to the final receptor 8.

Figure 6A:
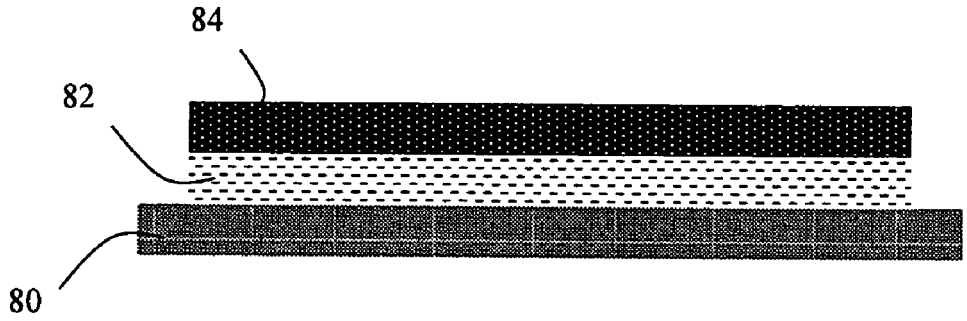
FIGS. 6*a*, 6*b* and 6*c* are side schematic views of an arrangement of toner and transfer assist layers in the steps involving toner transfer from a photoreceptor to an intermediate transfer member, then to a final receptor, where a transfer assist layer is applied to the photoreceptor before an ink/toner layer is applied.
Figure 6B:
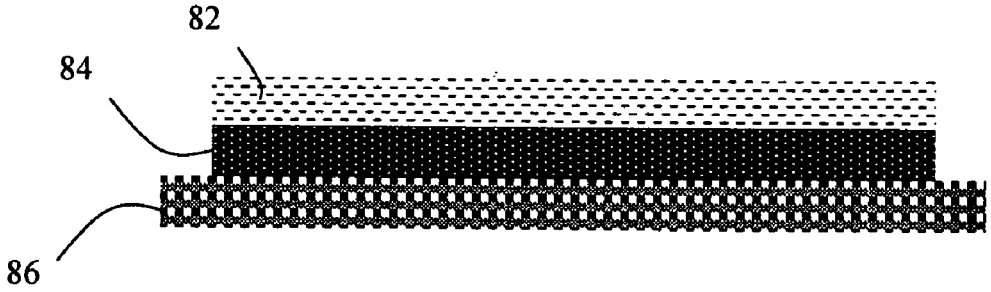
Figure 6C:
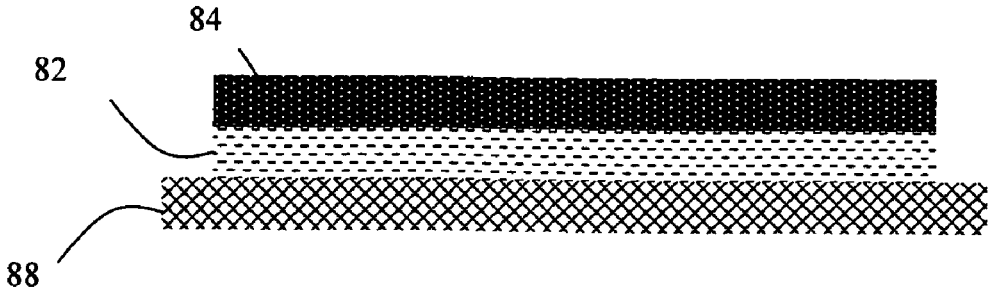

As discussed relative to FIG. 1, a transfer assist layer may be applied either before or after the application of a liquid toner on the photoreceptor. When such a transfer assist layer is used, it may be placed in any developer position because the mechanisms and/or software that control the movement of development units to contact the photoreceptor can control the timing of the application of the transfer assist material. In another embodiment of the present invention, FIG. 6*a* shown a first step of an electrophotographic process using equipment similar to that shown in FIG. 5. In FIG. 6*a*, a transfer assist layer 82 is first applied to a photoreceptor 80, then a toner layer 84 comprising one or more toner colors is applied on top of the transfer assist layer 82. When the toner accumulation is complete, the complete or composite image may then be transferred to an intermediate transfer member 86, as shown schematically in FIG. 6*b*. In this step, the toner layer 84 is transferred to the intermediate transfer member 86, and the transfer assist layer 82 is then "on top" of the layers. A final step of this process is illustrated in FIG. 6*c*, in which the image is transferred to the final receptor or substrate 88. This results in the transfer assist layer 82 being positioned between the final receptor 88 and the toner layer 84, with the toner layer 84 "on top."

In this embodiment of the process (i.e., using an intermediate transfer member), the transfer assist layer can function either as a release layer as described for FIGS. 2*a* and 2*b*, or as a "sacrificial layer" that can split as described for FIG. 3*b*. These functions of the transfer assist layer are primarily determined by the position of this layer relative to the photoreceptor and toner layers. In one aspect, the transfer assist layer shown as layer 82 in FIGS. 6*a* through 6*c* may be partially left on the photoreceptor 80 (not shown) in the transfer to the intermediate transfer member 86. In this embodiment, the transfer assist layer 82 in FIG. 6*b* would be at least slightly less thick than the initial transfer assist layer 82 of FIG. 6*a*. The transfer assist layer 82 can also function as described relative to FIG. 4, improving transfer by chemical and electrical bonding with the toner particles 84 and encouraging adhesion to the final receptor 88. Additionally, all of the additional benefits and properties discussed above that are unrelated to the actual transfer performance and that may be included in the transfer assist layer (including abrasion and UV protection and adhesion promotion, for example) may also be included within the scope of this embodiment.

In yet another embodiment of the present invention, the layers shown in FIG. 6*a* could alternatively include only the toner layer 84 applied on the photoreceptor 80 (i.e., the transfer assist layer 82 would not be applied in this step). Instead of applying the transfer assist material layer to the photoreceptor over the toned image layer the transfer assist layer 82 could be initially applied over at least a portion of the toner layer 84 after it has been transferred to the intermediate transfer member 86 in FIG. 6*b*. Although not particularly illustrated in FIG. 5, a larger intermediate transfer member could be used to provide enough space for a cartridge and applicator to meter or imagewise transfer the transfer assist layer 82 on top of the final toned image.

Figure 7A:
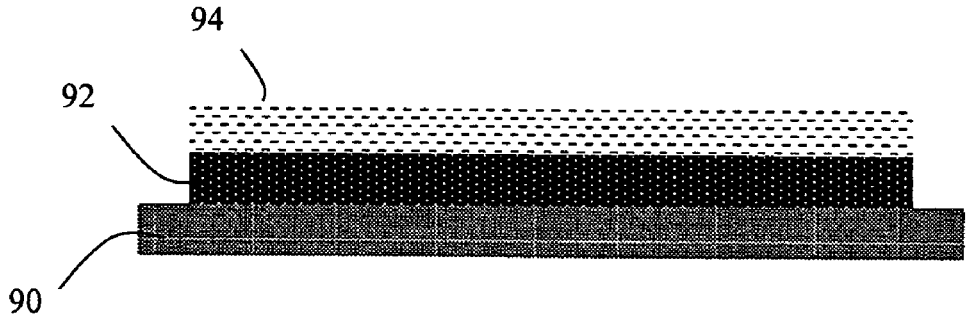
FIGS. 7*a*, 7*b* and 7*c* are side schematic views of an arrangement of toner and transfer assist layers in the steps involving toner transfer from a photoreceptor to an intermediate transfer member, then to a final receptor, where a transfer assist layer is applied to the photoreceptor after an ink/toner layer is applied.
Figure 7B:
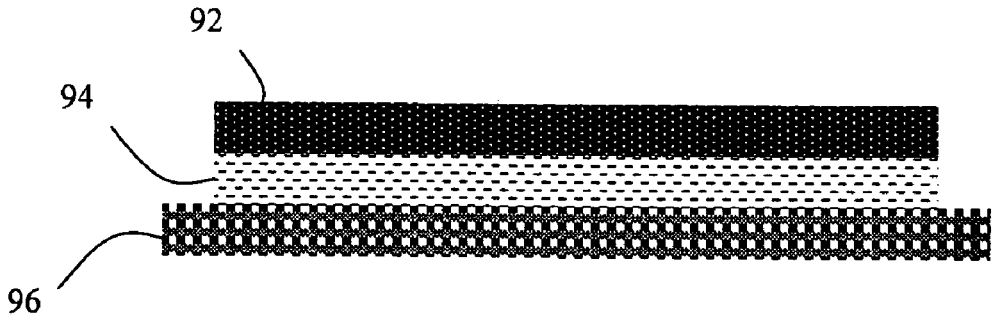
Figure 7C:
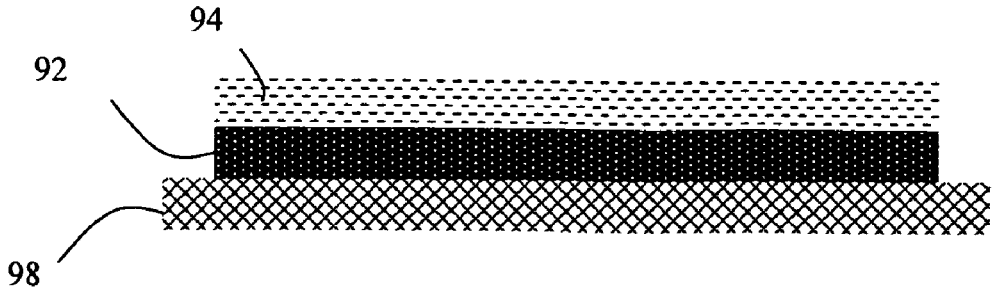

FIGS. 7*a*-7*c* illustrate the transfer steps and layer arrangement for a process using an intermediate transfer member, where the transfer assist layer is placed on the photoreceptor after the toned image is completely formed. As shown in FIG. 7*a*, a toner layer 92 is applied to or positioned on a photoreceptor 90, with a transfer assist layer 94 applied over the top of the toned image 92. In the next step of the process, shown in FIG. 7*b*, the image is transferred to the intermediate transfer member 96, leaving the transfer assist layer 94 in contact with the intermediate transfer member 96 and the toner layer 92 exposed. A final step in this process is shown in FIG. 7*c*, in which the image is transferred to a final receptor 98, so that the toner layer 92 is in contact with the receptor 98 and the transfer assist layer 94 is exposed.

This embodiment advantageously utilizes the ability of the transfer assist layer 94 to act as a release or sacrificial layer from the intermediate transfer member 96, where such advantages of this layer are similar to those described above relative to FIGS. 2 and 3. It is also possible to avoid the application of the transfer assist layer 94 over the toner layer 92 on the photoreceptor 90 (as in FIG. 7*a*), and to instead apply the transfer assist layer 94 with a metering roller or imagewise (not shown) before the toned image on the intermediate transfer member 96. This could be embodied in the apparatus of FIG. 5 by the addition of a cartridge or applicator (not shown) in contact with the intermediate transfer member 14 and between the photoreceptive element 2 and the final receptor 8. In this case, the transfer assist material is applied to the intermediate transfer member 14 before the image is transferred from the photoreceptor 2 to the intermediate transfer member 14. Additionally, this embodiment takes advantage of the transfer assist layer 94 on the surface of the image 92 on the final receptor 98 to promote such features as ultraviolet protection and abrasion resistance, for example.

These embodiments above described basic arrangements of using a transfer assist layer in a multi-pass electrophotographic process that uses electrostatic transfer. In accordance with the present invention, the transfer assist layer can be applied between any toner layers, if desired. Further, it is possible for multiple transfer assist layers to be applied in a particular electrophotographic process, such as may be done so that various transfer assist layers may provide different advantageous properties to the image and processes.

Figure 8:
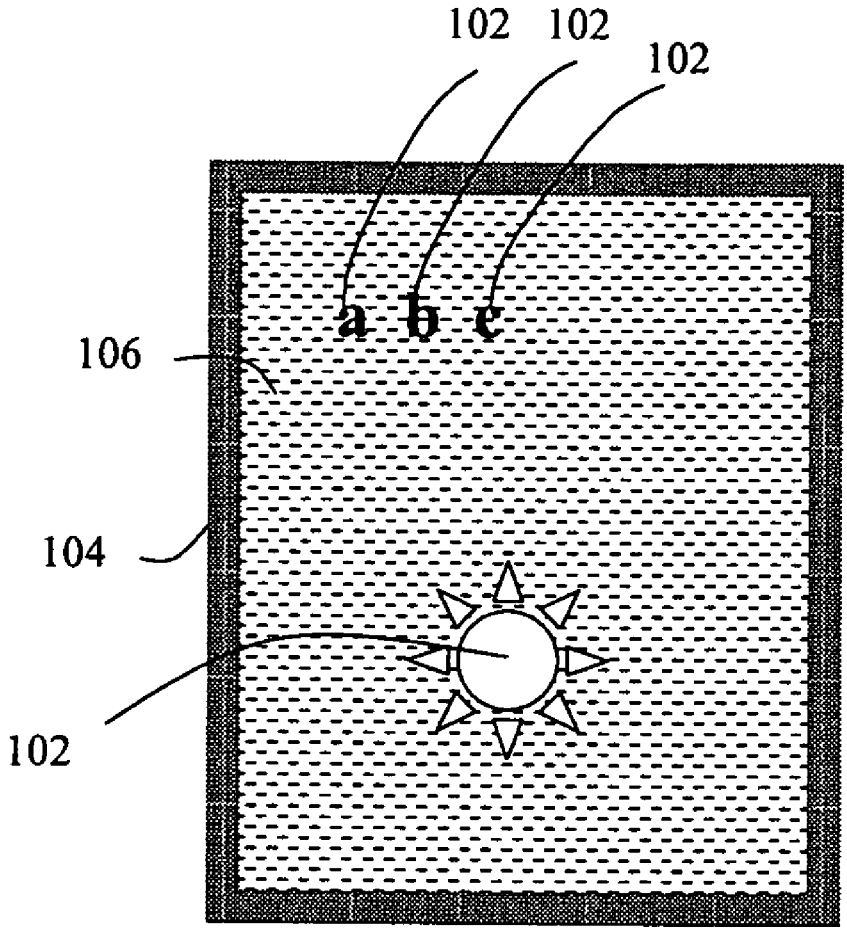
FIG. 8 is a top view of one example of an image plated onto a photoreceptor, where a transfer assist layer is applied initially to the entire imaging area.

The various figures for this invention illustrate a transfer assist layer that covers the same approximate area as the toner patch or toner layers. This is for representative purposes only, where actual applications may include toner layers and transfer assist layers of various thicknesses and coverage areas, even within a single imaging process. For example, FIG. 8 illustrates a photoreceptor 104 plated or generally covered with a transfer assist layer 106 that will contact the final receptor (not shown). This transfer assist layer may be applied as a "flood coating", for example, where the entire drum or photoreceptor is coated with the transfer assist material before the application of any toner images. This might be particularly useful if the transfer assist layer 106 is to end up on the surface of the printed image, such as to serve as a protective coating. The toner may then be applied in an imagewise manner on top of the transfer assist layer 106 in toner image areas 102 that have been discharged. Subsequently, both the toner in the image areas 102 and transfer assist layer 106 may be transferred to a final image receptor (not shown).

Figure 9A:
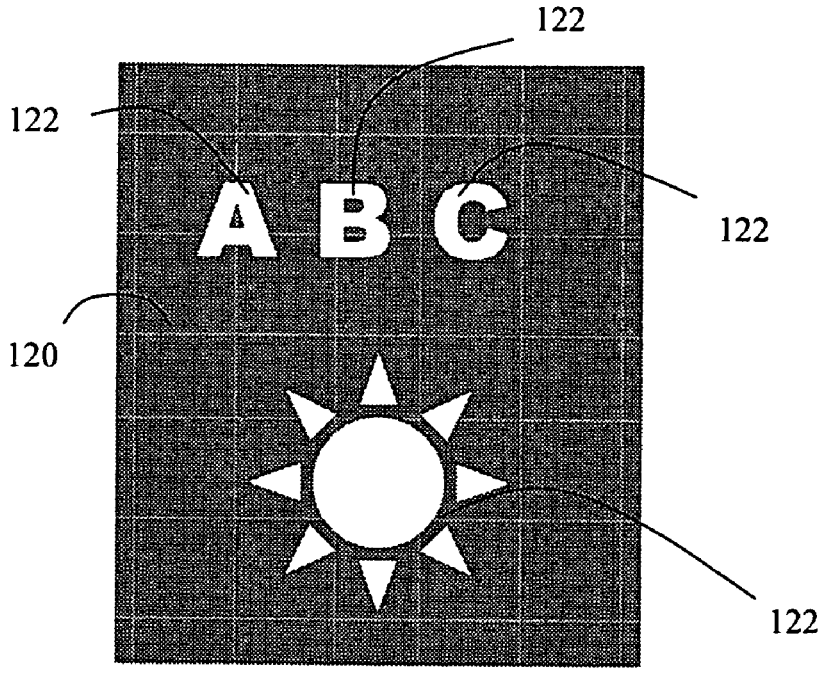
FIGS. 9*a* and 9*b* are top views of an image plated onto a photoreceptor, illustrating how the transfer assist layer is applied to only those areas that receive pigmented liquid toner.
Figure 9B:
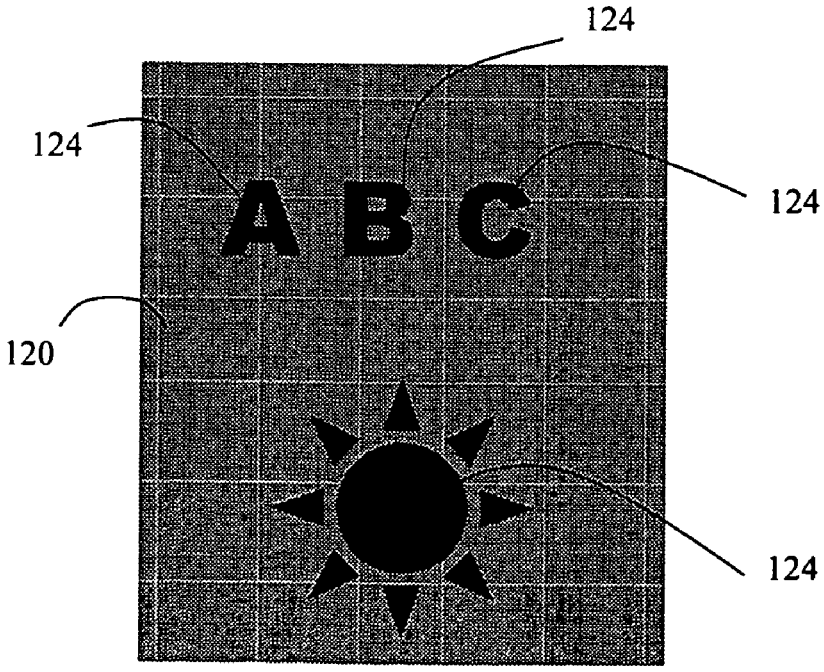

In some cases, it would be wasteful to apply the transfer assist material to background areas. As seen in FIG. 9*a*, the transfer assist material may be applied to a photoreceptor 120 in an imagewise manner in which the transfer assist particles deposit only on discharged image areas 122 that correspond to areas to which toner particles will subsequently be deposited, such that the areas surrounding these image areas 122 will be void of any applied transfer assist material. Toner images 124 made up of charged toner particles may then be formed over the transfer assist layer 122, as shown in FIG. 9*b*. In this manner there is a substantial superposition of the toner particles on the transfer material. This type of system might be most desired where the primary purpose of the transfer assist layer or material is to provide a release from the photoreceptor or the intermediate transfer member.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A method of producing an image on a final image receptor from image data in a multiple pass electrophotographic system, comprising the steps of:

providing a photoreceptive element having a determined processing cycle;

providing at least one development unit containing charged toner particles dispersed in a carrier liquid, wherein at least one of the photoreceptive element and each development unit are moved into a processing position relative to each other and performing the following steps (a) through (c) for each development unit during each complete processing cycle of the photoreceptive element;

(a) applying a substantially uniform first electrostatic potential to the surface of the photoreceptive element;

(b) selectively photodischarging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the charged toner particles, wherein the charged toner particles selectively deposit on the discharged portions of the surface of the photoreceptive element to develop the first latent image and create a toned image;

providing a transfer assist material development unit containing a liquid transfer assist material comprising charged particles;

moving at least one of the photoreceptive element and the transfer assist material development unit into a processing position relative to each other and applying the transfer assist material to at least a portion of the toned image during the processing cycle of the photoreceptive element to form a composite image layer on the photoreceptive element; and contacting the composite image layer with a final image receptor while applying an electrostatic bias potential through the final image receptor that is sufficiently strong to transfer at least a portion of the composite image layer from the photoreceptive element to the final image receptor.

2. The method of claim 1, wherein the bias applied through the final image receptor for transfer of at least a portion of the composite image layer has an opposite polarity to the polarity of the charged particles comprising the composite image on the photoreceptive element.

3. The method of claim 1, further comprising the step of fusing at least a portion of the transferred composite image layer onto the final image receptor.

4. The method of claim 1, wherein the steps (a) through (c) are repeated sequentially by at least two development units, and wherein each sequence of the steps (a) through (c) is performed during a separate processing cycle of the photoreceptive element.

5. The method of claim 1, wherein the photoreceptive element is rotatable.

6. The method of claim 5, wherein the photoreceptive element comprises a photoreceptive drum.

7. The method of claim 1, wherein the charged toner particles have a glass transition temperature greater than about 35° C.

8. The method of claim 1, wherein the charged toner particles have the same polarity as the photoreceptive element.

9. The method of claim 1, wherein the charged particles of the transfer assist material have a volume mean particle size greater than one micron.

10. The method of claim 1, wherein the transfer assist material comprises a non-pigmented liquid toner.

11. The method of claim 1, wherein the transfer assist material comprises an additive to enhance adhesion of the image layer to the final image receptor.

12. The method of claim 1, wherein the transfer assist material comprises an additive to enhance durability of the image layer on the final image receptor.

13. The method of claim 1, wherein the charged particles of the transfer assist material have a glass transition temperature between about −10° C. and about 35° C.

14. The method of claim 1, wherein the final image receptor comprises paper.

15. The method of claim 1, wherein the step of applying the transfer assist material to at least a portion of the toned image when the transfer assist material development unit is in its processing position relative to the photoreceptive element comprises the steps of applying a substantially uniform electrostatic potential to the surface of the toned image on the photoreceptive element, selectively photodischarging at least a portion of the surface of the toned image on the photoreceptive element in an imagewise manner to create a latent image, and selectively depositing the transfer assist material on at least the discharged regions of the photoreceptive element.

16. The method of claim 1, wherein the step of selectively photodischarging portions of the surface of the photoreceptive element comprises selectively exposing portions of the surface of the photoreceptive element to actinic radiation comprising one or more of ultraviolet light, visible light, and infrared light.

17. The method of claim 1, further comprising the step of contacting the composite image layer with an intermediate transfer member having an electrostatic bias potential that is sufficiently strong to transfer at least a portion of the composite image layer from the photoreceptive element to the intermediate transfer member prior to contacting the composite image layer with a final image receptor.

18. The method of claim 17, wherein the charged particles of the transfer assist material have a glass transition temperature greater than about 35° C.

19. The method of claim 1, wherein the charged particles of the transfer assist material exhibit surface release characteristics.

20. A method of producing an image on a final image receptor from image data in a multiple pass electrophotographic system, comprising the steps of:

providing a photoreceptive element having a determined processing cycle;

providing a transfer assist material development unit containing a liquid transfer assist material comprising charged particles;

moving at least one of the photoreceptive element and the transfer assist material development unit into a processing position relative to each other and applying the transfer assist material to at least a portion of the surface of the photoreceptive element during a processing cycle of the photoreceptive element;

providing at least one development unit containing charged toner particles dispersed in a carrier liquid, wherein at least one of the photoreceptive element and each development unit are moved into a processing position relative to each other and performing the following steps (a) through (c) for each development unit during each complete processing cycle of the photoreceptive element;

(a) applying a substantially uniform first electrostatic potential to the surface of the photoreceptive element;

(b) selectively photodischarging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the charged toner particles, wherein the charged toner particles selectively deposit on the discharged portions of the surface of the photoreceptive element to develop the first latent image and create a toned image on at least a portion of the transfer assist material;

wherein the transfer assist material and the toned image on the photoreceptive element form a composite image layer that is formed during the multiple processing cycles completed by the photoreceptive element; and contacting the composite image layer with a final image receptor while applying an electrostatic bias potential through the final image receptor that is sufficiently strong to transfer at least a portion of the composite image layer from the photoreceptive element to the final image receptor.

21. The method of claim 20, wherein the bias applied through the final image receptor for transfer of at least a portion of the composite image layer has an opposite polarity to the polarity of the charged particles comprising the composite image on the photoreceptive element.

22. The method of claim 21, wherein the charged particles of the transfer assist material have a glass transition temperature between about −10° C. and about 35° C.

23. The method of claim 20, further comprising the step of fusing at least a portion of the transferred composite image layer onto the final image receptor.

24. The method of claim 20, wherein the steps (a) through (c) are repeated sequentially by at least two development units, and wherein each sequence of the steps (a) through (c) is performed during a separate processing cycle of the photoreceptive element.

25. The method of claim 20, wherein the photoreceptive element is rotatable.

26. The method of claim 25, wherein the photoreceptive element comprises a photoreceptive drum.

27. The method of claim 20, wherein the charged toner particles have a glass transition temperature greater than about 35° C.

28. The method of claim 20, wherein the charged toner particles have the same polarity as the photoreceptive element.

29. The method of claim 20, wherein the charged particles of the transfer assist material have a volume mean particle size greater than one micron.

30. The method of claim 20, wherein the transfer assist material comprises a non-pigmented liquid toner.

31. The method of claim 20, wherein the charged particles of the transfer assist material exhibit surface release characteristics.

32. The method of claim 20, wherein the transfer assist material comprises an additive to enhance durability of the image layer on the final image receptor.

33. The method of claim 20, wherein the charged particles of the transfer assist material have a glass transition temperature greater than about 35° C.

34. The method of claim 20, wherein the final image receptor comprises paper.

35. The method of claim 20, wherein the step of applying the transfer assist material to the photoreceptive element comprises the steps of applying a substantially uniform electrostatic potential to the surface of the photoreceptive element, selectively photodischarging at least a portion of the surface of photoreceptive element in an imagewise maimer to create a latent image, and selectively depositing the transfer assist material on at least the discharged regions of the photoreceptive element.

36. The method of claim 20, wherein the step of selectively photodischarging portions of the surface of the photoreceptive element comprises selectively exposing portions of the surface of the photoreceptive element to actinic radiation comprising one or more of ultraviolet light, visible light, and infrared light.

37. The method of claim 20, said contacting the composite image layer with a final image receptor comprising the steps of:

contacting the composite image layer with an intermediate transfer member having an electrostatic bias potential that is sufficiently strong to transfer at least a portion of the composite image layer from the photoreceptive element to the intermediate transfer member; and contacting the composite image layer with a final image receptor while applying an electrostatic bias potential through the final image receptor that is sufficiently strong to transfer at least a portion of the composite image layer from the intermediate transfer member to the final image receptor.

38. The method of claim 20, wherein the transfer assist material comprises an additive to enhance adhesion of the image layer to the final image receptor.

39. A method of producing an image on a final image receptor from image data in a multiple pass electrophotographic system, comprising the steps of:

providing a photoreceptive element having a determined processing cycle;

providing at least one development unit containing charged toner particles dispersed in a first carrier liquid, wherein at least one of the photoreceptive element and each development unit are moved into a processing position relative to each other and performing the following steps (a) through (c) for each development unit during each complete processing cycle of the photoreceptive element;

(a) applying a substantially uniform first electrostatic potential to the surface of the photoreceptive element;

(b) selectively photodischarging portions of the surface of the photoreceptive element in an imagewise manner to create a first latent image having a second electrostatic potential that is less than the absolute value of the first electrostatic potential on the surface of the photoreceptive element; and (c) exposing the surface of the photoreceptive element to the charged toner particles, wherein the charged toner particles selectively deposit on the discharged portions of the surface of the photoreceptive element to develop the first latent image and create a toned image;

forming a composite image layer from the toned image on an intermediate transfer member by using a transfer assist material development unit containing a liquid transfer assist material comprising charged particles dispersed in a second carrier liquid; and contacting the composite image layer with a final image receptor while applying an electrostatic bias potential through the final image receptor that is sufficiently strong to transfer at least a portion of the composite image layer from the intermediate transfer member to the final image receptor.

40. The method of claim 39, wherein the bias applied through the final image receptor for transfer of at least a portion of the composite image layer has an opposite polarity to the polarity of the charged particles comprising the composite image on the photoreceptive element.

41. The method of claim 39, further comprising the step of fusing at least a portion of the transferred composite image layer onto the final image receptor.

42. The method of claim 39, wherein the steps (a) through (c) are repeated sequentially by at least two development units, and wherein each sequence of the steps (a) through (c) is performed during a separate processing cycle of the photoreceptive element.

43. The method of claim 39, wherein the photoreceptive element is rotatable.

44. The method of claim 43, wherein the photoreceptive element comprises a photoreceptive drum.

45. The method of claim 39, wherein the charged toner particles have a glass transition temperature greater than about 35° C.

46. The method of claim 39, wherein the charged toner particles have the same polarity as the photoreceptive element.

47. The method of claim 39, wherein the transfer assist material comprises a non-pigmented liquid toner.

48. The method of claim 39, wherein the transfer assist material comprises an additive to enhance adhesion of the image layer to the final image receptor.

49. The method of claim 39, wherein the charged particles of the transfer assist material comprises an additive to enhance durability of the image layer on the final image receptor.

50. The method of claim 39, wherein the charged particles of the transfer assist material have a glass transition temperature between about −10° C. and about 35° C.

51. The method of claim 39, wherein the final image receptor comprises paper.

52. The method of claim 39, wherein the step of applying the transfer assist material to at least a portion of the toned image when the transfer assist material development unit is in its processing position relative to the intermediate transfer member comprises the steps of applying an electrostatic bias potential to the intermediate transfer member and electrostatically depositing the charged transfer assist material to the surface of the intermediate transfer member over at least a portion of the toned image.

53. The method of claim 39, wherein the step of selectively photodischarging portions of the surface of the photoreceptive element comprises selectively exposing portions of the surface of the photoreceptive element to actinic radiation comprising one or more of ultraviolet light, visible light, and infrared light.

54. The method of claim 39, said forming a composite image layer from the toned image comprising the steps of:

contacting the toned image with an intermediate transfer member having an electrostatic bias potential that is sufficiently strong to transfer at least a portion of the toned image from the photoreceptive element to the intermediate transfer member;

providing a transfer assist material development unit containing a liquid transfer assist material comprising charged particles; and moving at least one of the intermediate transfer member and the transfer assist material development unit into a processing position relative to each other and applying the transfer assist material to at least a portion of the toned image to form a composite image layer on the intermediate transfer member.

55. The method of claim 39, said forming a composite image layer from the toned image comprising the steps of:

providing a transfer assist material development unit containing a liquid transfer assist material comprising charged particles;

moving at least one of an intermediate transfer member and the transfer assist material development unit into a processing position relative to each other and applying the transfer assist material to at least a portion of the surface of the intermediate transfer member that will receive the toned image; and contacting the toned image with the intermediate transfer member while applying an electrostatic bias potential through the intermediate transfer member that is sufficiently strong to transfer at least a portion of the toned image from the photoreceptive element to the intermediate transfer member to form a composite image layer, wherein at least a portion of the toned image is positioned on at least a portion of the transfer assist material on the intermediate transfer member, and wherein the composite image layer is formed during the multiple processing cycles completed by the photoreceptive element.

* * * * *